United States Patent [19]

Meier

[11] 4,214,743

[45] Jul. 29, 1980

[54] APPARATUS FOR DIVIDING A CONTINUOUS STREAM OF FLAT PRODUCTS, ESPECIALLY PRINTED PRODUCTS, INTO INDIVIDUAL SECTIONS

[75] Inventor: Jacques Meier, Zurich, Switzerland

[73] Assignee: Ferag AG, Hinwil, Switzerland

[21] Appl. No.: 949,516

[22] Filed: Oct. 10, 1978

[30] Foreign Application Priority Data

Oct. 24, 1977 [CH] Switzerland ..... 12893/77
Nov. 25, 1977 [CH] Switzerland ..... 14462/77

[51] Int. Cl.[3] ..... B65H 29/66; B65H 29/68; B65H 33/12

[52] U.S. Cl. ..... 271/182; 198/425; 271/184; 271/202; 271/DIG. 9

[58] Field of Search ..... 271/182, 183, 229, 230, 271/231, 256, 184, 225, DIG. 9, 202, 204, 85, 268; 198/425, 423; 93/93 DP, 93 C

[56] References Cited

U.S. PATENT DOCUMENTS

| | | | |
|---|---|---|---|
| 1,068,106 | 7/1913 | Christopher | 271/230 |
| 2,729,042 | 1/1956 | Brook | 271/85 X |
| 4,012,033 | 3/1977 | Parrish | 271/184 X |
| 4,136,865 | 1/1979 | Marass | 271/182 X |

FOREIGN PATENT DOCUMENTS

| | | | |
|---|---|---|---|
| 936269 | 9/1963 | United Kingdom | 271/256 |

OTHER PUBLICATIONS

Herron, T. F., Jr. "Cut Forms Interruptor" *IBM Technical Disclosure Bulletin,* vol. 15, No. 3, Aug. 1972, p. 785.

*Primary Examiner*—Bruce H. Stoner, Jr.
*Attorney, Agent, or Firm*—Werner W. Kleeman

[57] ABSTRACT

An apparatus for dividing an imbricated stream of printed products into individual mutually separated sections, comprising a separator device which, in the conveying direction of a conveyor device, can be moved with a speed which is smaller than the conveying speed of such conveyor device. The separator device is equipped with a clamping device which selectively retains, for a certain time, a printed product and which can be forwardly moved at the speed of motion of the separator device. Owing to the lower speed of movement of the fixedly-retained printed product, in relation to the conveying speed of the conveyor device, there is formed a gap with respect to the leading printed product of the preceding section and which printed product moves forwardly at the full conveying speed. By means of this gap the successive sections can be separated from one another. The printed product which is fixedly retained by the clamping device serves as conveyor element for the successive or trailing printed products which come into contact therewith in an imbricated product stream.

12 Claims, 4 Drawing Figures

APPARATUS FOR DIVIDING A CONTINUOUS STREAM OF FLAT PRODUCTS, ESPECIALLY PRINTED PRODUCTS, INTO INDIVIDUAL SECTIONS

BACKGROUND OF THE INVENTION

The present invention relates to a new and improved construction of apparatus for dividing a continuous stream, especially an imbricated stream of flat products or articles, preferably printed products, into individual sections and contains at least one conveyor device for conveying the products.

It is known to the art to divide an imbricated product stream into individual sections, for instance by introducing a separator element into such imbricated product stream in a manner such that the products, by means of the action of such separator element, are prevented for a certain amount of time from being conveyed further by the conveyor device. The products which are conveyed against the separator or separating element are dammed-up by the inserted separator element. Upon arrival of the products at the already dammed-up products and upon insertion of the separator element it is possible for the products to become damaged. Upon release of the dammed-up products, such are approximately simultaneously further conveyed, which, in the next following processing station, results in a momentary, sudden presence of products, thereby rendering more difficult the proper processing of the products. In the case of an imbricated product stream due to this dammed-up action the imbricated product formation is disturbed or annihilated.

SUMMARY OF THE INVENTION

Hence, with the foregoing in mind it is a primary object of the present invention to overcome these drawbacks.

Another more specific object of the present invention aims at a new and improved construction of apparatus for dividing a continuous stream of flat products, especially printed products, into individual sections in an extremely reliable, efficient and accurate manner, without danger of damaging the products or disturbing the desired formation of such products.

Yet a further significant object of the present invention is to devise an apparatus of the previously mentioned type which affords a relatively faultless and protective division of a continuous stream of flat products into individual sections, so that the products of one section can always be further processed without any difficulties.

Now in order to implement these and still further objects of the invention, which will become more readily apparant as the description proceeds, the invention contemplates providing a separator device which, in the direction of conveying of the conveyor device, can be moved at a speed which is less than the conveying speed of this conveyor device, and further, there is provided a clamping device which can be selectively rendered effectual and ineffectual for the selective and temporary fixed retention of a product.

Since the product, fixedly retained by the clamping device, moves in the conveying direction of the conveyor device, there is thus avoided any uncontrolled damming-up of the trailing products. Since the clamping device together with the fixedly retained product move at a speed which is less than the conveying speed of the conveyor device, an intermediate space or gap forms between the fixedly retained product and the last product of the leading section, this last product being entrained by the conveyor device. The successive sections can be separated from one another by means of such intermediate space or gap. The product which is fixedly held by the clamping device serves as a conveyor element for the trailing products which come into contact therewith.

Preferably, the aforementioned first conveyor device has arranged forwardly thereof a second conveyor device which infeeds the products. The second conveyor device is arranged above the first conveyor device at least at the region of transfer of the infed products by the first conveyor device. The separator device, in its starting position, is located at such transfer region.

At the region of transfer of the products by the first conveyor device there is freed at least one portion of each product, so that the clamping device can fixedly retain, without difficulty, the product at this released or freed portion, something which is especially of advantage with the products arrive in an imbricated product stream. Due to the transfer of the product from the one to the other conveyor device, there can beneficially be obtained the result that the mutual position of the products within a section is essentially the same as the mutual position of the products in the infed continuous product stream, in other words, for instance, likewise of imbricated formation.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
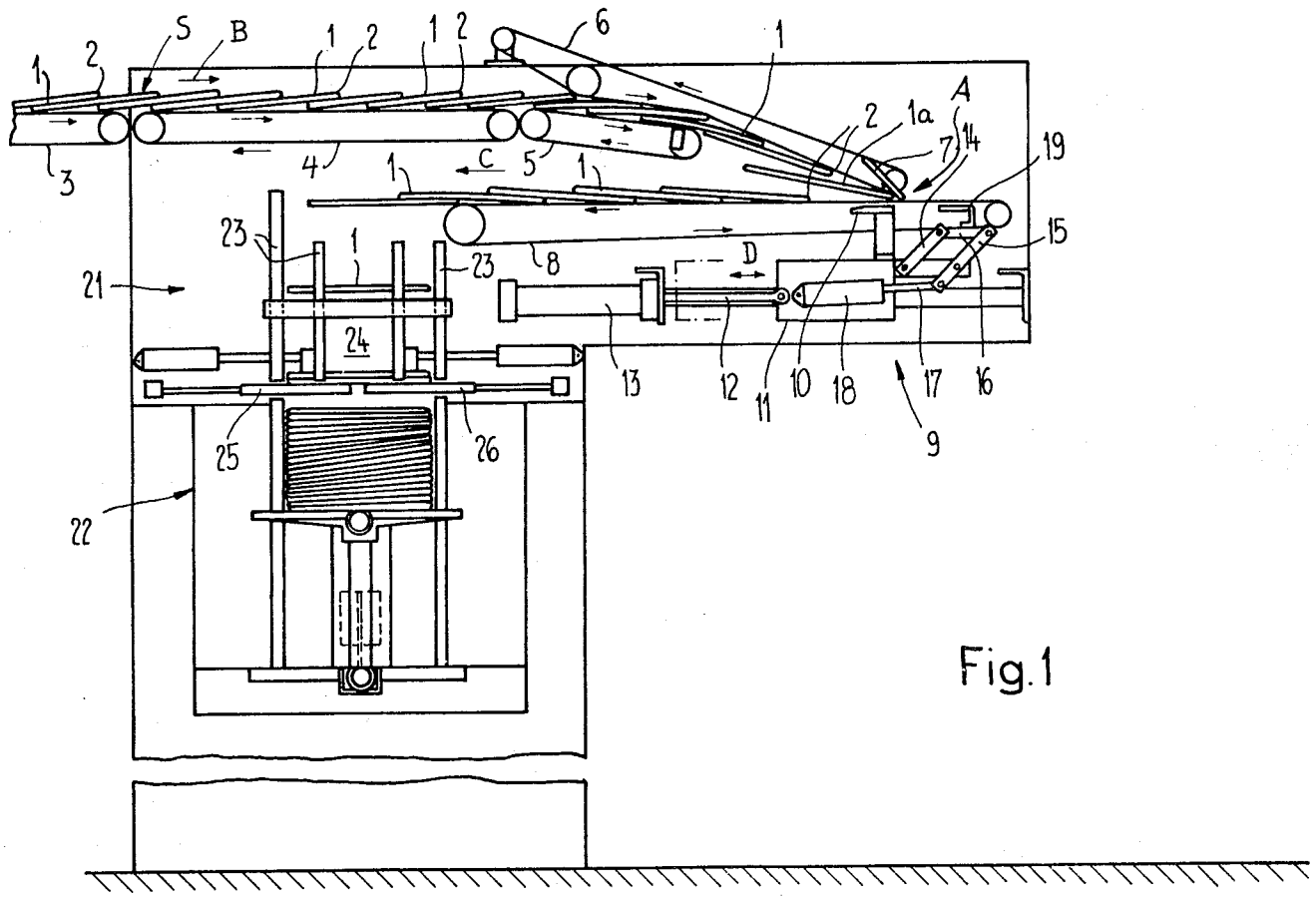
FIG. 1 is a schematic side view of an apparatus for dividing an imbricated stream of folded printed products into individual sections.

Describing now the drawings, in FIG. 1 there is schematically illustrated an apparatus which forms from folded printed products arriving in an imbricated product stream individual, mutually separated sections. The individual sections are subsequently further processed. The folded printed products are infed in the form of a fish-scale or imbricated product stream S in the direction of the arrow B by means of an only partially shown conveyor device, here in the form of a conveyor band or belt 3. The printed products 1 are located over one another in a fish-scale or imbricated arrangement, like the tiles of a roof, and the leading fold 2 (back or spine) is located at the top of the imbricated product stream S. A second conveyor device, here shown in the form of a conveyor band or belt 4 receives the printed products 1 from the conveyor belt 3 and conveys these printed products 1 in the same conveying direction B to a further conveyor device shown as a conveyor band or belt 5. This conveyor belt 5 is inclined with respect to the conveyor belt 4 and coacts with a conveyor belt or band 6 located thereabove. The printed products 1 are moved by both of the conveyor bands or belts 5 and 6 against an inclined impact or stop plate 7 against which the printed products 1 strike by means of their fold 2 and drop onto a further conveyor device, the conveyor band or belt 8 located therebelow. The direction of conveying C of the further conveyor belt 8 is opposite to the conveying direction B of the arriving imbricated product stream S. The printed products 1 are again deposited in the form of an imbricated product stream upon the conveyor band or belt 8, but, in contrast to the arriving imbricated product stream moved by the conveyor belts or bands 3 and 4, now the fold 2 forms the trailing and no longer the leading edge of the printed products 1. Therefore, a reversal of the direction of conveying of the printed products 1 has been accomplished, so that the fold 2, which was leading prior to such reversal, after the deflection or turning, now becomes the trailing edge. The uniform imbricated product formation is not disturbed by such turning or deflection. At the deflection location i.e., the impact member in the form of the impact or stop plate 7, the region of the leading edge 2 of each individual arriving printed product 1 is exposed or laid free, as such has been illustrated by the printed product designated by reference character 1*a*. Hence, at this region the printed product 1 is freely accessible both at the top as well as at the bottom.

Of course, conventional drive means can be used for driving the different conveyor bands or belts, such as typically, by way of example, but not limitation, sprocket chain drives or other suitable drive elements. Also the term "printed products" as used herein, is employed in a broader sense to encompass, whenever appropriate, products and the like which are for instance not yet printed.

In order to divide the continuous imbricated product stream into individual sections, separated from one another by a gap, at the region A of transfer of the printed products by the conveyor belt 8 there is provided a separator or separating device 9. This separating device 9, shown in FIG. 1 in its starting position, possesses a lower clamping jaw 10 attached to a carriage or slide 11 or equivalent structure. At this carriage 11 there engages a piston rod 12 of a pistion-and-cylinder unit 13. By means of this piston-and-cylinder unit 13 it is possible to move the carriage 11 back-and-forth, in other words to reciprocate the same, in the direction of the arrow D.

Furthermore, two levers 14 and 15 are pivotably mounted at the carriage 11. These pivotable levers 14 and 15 are interconnected at their ends by means of a connection element 16. The piston rod 17 of a piston-and-cylinder unit or device 18 engages at the lever 15, and this piston-and-cylinder unit is likewise secured at the carriage 11. The connection element 16 carries an upper clamping jaw 19. The levers 14 and 15 and the connection element 16 form a quadrilateral link arrangement, and the lever 15 thereof can be rocked by extending and retracting piston rod 17, whereby the upper clamping jaw 19 is moved towards the lower clamping jaw 10.

Figure 2:
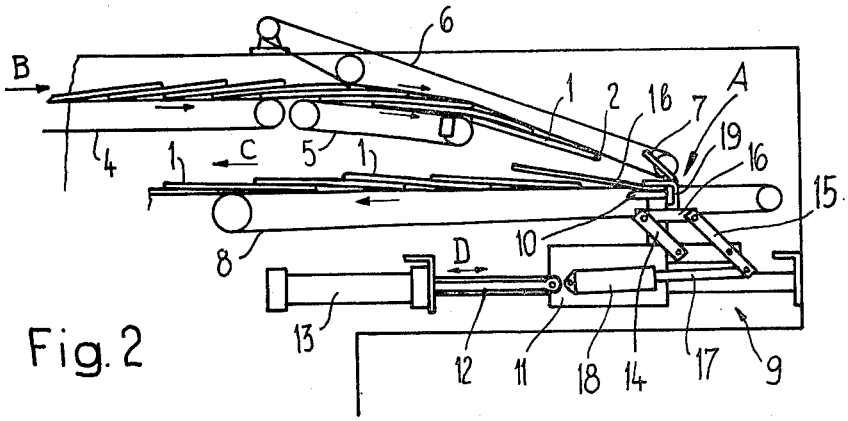
FIGS. 2, 3 and 4 are respective schematic side views of a part of the apparatus shown in FIG. 1 during different operational cycles or phases thereof.
Figure 3:
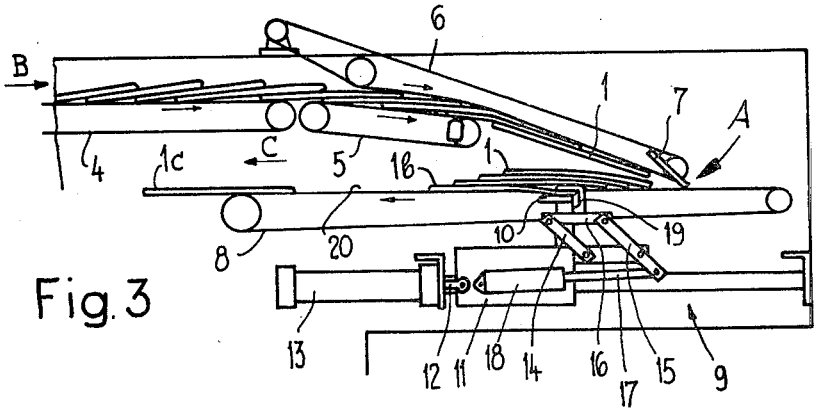
Figure 4:
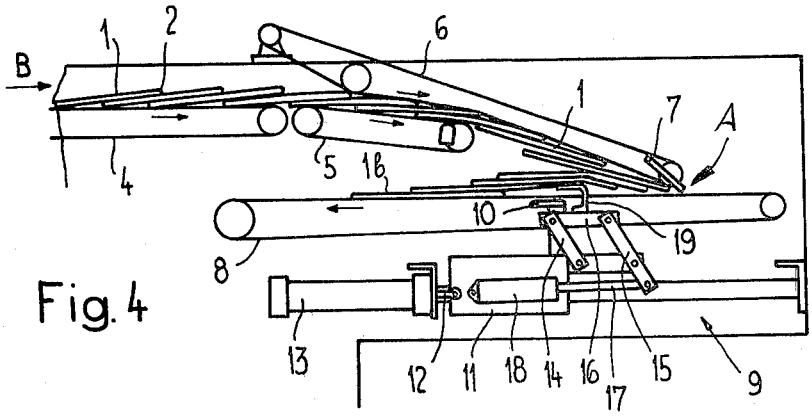

There will now be considered the mode of operation of the separator device 9 based upon the showing of FIGS. 2, 3 and 4 illustrating part of the apparatus of FIG. 1. Now if for the subsequent processing of the printed products delivered in a continuous imbricated product stream by the conveyor devices in the form of the transport belts 3, 4, 5 and 6, this imbricated product stream should be subdivided into individual sections, then by extending the piston rod 17 the lever 15 is rocked or pivoted, which, in turn, initiates rocking of the upper clamping jaw 19 out of the rest position, shown in FIG. 1, into the work position. In this work position, which has been shown in FIG. 2, the upper clamping jaw 19 presses the now freed end of the printed product 1*b* arriving at the impact plate 17 against the lower clamping jaw 10 which is located in its starting or initial position. The printed product 1*b* now is fixedly retained by both of the clamping jaws 10 and 19 and can no longer be freely entrained by the conveyor belt 8.

Now by retracting the piston rod 12 the carriage 11 along with both of the clamping jaws 10 and 19 which fixedly hold the printed product 1*b* are shifted towards the left in the direction of the arrow D, and specifically, at a speed which is less than the conveying speed of the conveyor belt 8. The feed or advance speed of the carriage 11, and thus, the clamping jaws 10 and 19, can amount to, for instance, about one-third of the conveying speed of the conveyor belt 8. As a result, there is formed a gap or space 20, as best seen by referring to FIG. 3, between the last printed product 1*c* which is still entrained at the full conveying speed by the conveyor belt 8 and the fixedly retained printed product 1*b*.

The printed products 1 trailing the fixedly retained printed product 1*b*, come to lie upon such printed product 1*b* and specifically, as best seen by referring to FIG. 3, likewise in an imbricated formation or array, since the printed product 1*b* moves away from the stop or impact plate 7 in the conveying direction C. The fixedly retained printed product 1*b* now assumes the function of a conveyor element for the printed products lying thereon instead of the conveyor belt or band 8.

Now if by retracting the piston rod 17 the upper clamping jaw 19 again is lifted off of the lower clamping jaw 10, then the now freed printed products can be further conveyed by the conveyor belt 8 at the full conveying speed as the same has been illustrated in FIG. 4. The carriage 11 is now again returned back into its starting position. The separator device 9 is now ready to carry out the next gap formation, i.e., forms the next section.

In contrast to the heretofore known equipment for forming a gap in an imbricated product stream, wherein the printed products are stopped for a certain amount of time, during which the products dam-up, with the described exemplary arrangement the printed products are not completely stopped. Quite to the contrary, they are further conveyed, even if at a reduced speed. A release of the retained or held-back printed products, with the illustrated embodiment, affords a more uniform arrival of printed products at the next following processing station than in the case where there is formed a dam-up of the printed products as considered heretofore with respect to the prior art equipment.

With the exemplary embodiment shown in FIG. 1 the processing station arranged following the separator device 9 constitutes a stacking and package forming device composed of a stacker unit 21 and a package forming unit or device 22 arranged therebelow. Details of the construction and mode of operation of possible types of stacker and package forming devices or units 21 and 22, which can be used with the invention, have been disclosed in detail in the commonly assigned, U.S. application Ser. No. 855,357, filed Nov. 28, 1977, now adandoned, entitled "Apparatus for stacking folded, continuously arriving printed products, especially products arriving in an imbricated product stream", and further, details of a package forming unit have also been disclosed in the commonly assigned, U.S. application Ser. No. 855,412, filed Nov. 28, 1977, now U.S. Pat. No. 4,140,052, entitled "Apparatus for compressing a stack of folded, essentially flat products, especially printed products". Reference may be had to both of these applications and the disclosure of which is incorporated herein by reference. Therefore, the stacker device 21 and the package forming device 22 only will be considered briefly hereinafter.

The stacker device 21 possesses a stacker or stacking chute 21 or equivalent structure which is bounded or fixed in its geometry by the boundary ledges 23. Within the stacker or stacking chute 24 there are stacked the printed products 1 which are infed by the conveyor belt 8. If all of the printed products of a section formed in the previously described manner, are stacked in the stacking chute 24, then during the time span until arrival of the printed products 1 of the next following section, the stacker chute 24 is emptied. This occurs by opening the displaceable slide plates 25 and 26 which close the stacking chute 24 at its lower end. The package forming unit or device 22 receives this stack from the stacker chute 24 and forms, in known manner, packages or bundles of crosswise piled stacks. After closing the slide plates 25 and 26 there are formed the printed products 1 of the next following section.

With the described exemplary embodiments the continuous imbricated stream is divided into individual sections separated by intermediate spaces or gaps because the subsequent processing station, i.e., the stacker unit, can not be continuously furnished with products to be processed. The continuous stream of products can also be divided for other reasons, in the described manner, into individual sections, thus, for instance, whenever the products are to be infed in sections to different subsequently arranged processing stations.

It should be understood that the subdivision of the continuous product stream is also then possible in the described manner if the conveying direction C of the conveyor belt 8 is not opposite to the conveying direction B of the infeed devices or conveyors 3, 4, 5 and 6, rather, for instance, travels at an angle thereto of about ninety degrees.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for dividing a continuous stream, especially an imbricated product stream, of flat products, preferably printed products, into individual sections, comprising:

A first conveyor device for feeding the products, said first conveyor device having a predetermined conveying direction;

a second conveyor device arranged after the first conveyor device;

said second conveyor device and said first conveyor device coacting with one another so as to define a region of transfer for the products from the first conveyor device to the second conveyor device;

said second conveyor device, at least at the transfer region, being arranged below said first conveyor device;

said second conveyor device, at least at the transfer region, having a conveying direction opposite to the conveying direction of the first conveyor device;

a clamping device for selectively and temporarily fixedly holding at least one product;

means for moving the clamping device in the conveying direction of the second conveyor device between a starting position and an end position at a speed which is less than the conveying speed of the second conveyor device; and means for activating said clamping device for selectively and temporarily fixedly holding at least one product moving in the conveying direction of the second conveyor device during the movement of the clamping device thereby dividing the continuous stream into individual sections, and for subsequently deactivating said clamping device for allowing said at least one held product to be again conveyed by said second conveyor device.

2. The apparatus as defined in claim 1, wherein:

said clamping device has its starting position located at said region of transfer.

3. The apparatus as defined in claim 1, wherein:

said first conveyor device has a conveying path arranged above the second conveyor device;

stop means arranged at said conveying path of the first conveyor device;

said stop means serving as impact means for the products infed by the first conveyor device; and said clamping device in said starting position being located at the region of said stop means.

4. The apparatus as defined in claim 1, further including:

a carriage;

said means for moving the clamping device movably driving said carriage in the direction of the conveying of said second conveyor device;

said clamping device comprising two clamping jaws arranged at said carriage;

said two clamping jaws defining a first clamping jaw and a second clamping jaw;

the first clamping jaw being secured to said carriage; and said means for activating said clamping device moving the second clamping jaw towards the first clamping jaw for fixedly holding a product and away from said first clamping jaw for releasing the product.

5. The apparatus as defined in claim 4, wherein:

said activating means for moving said second clamping jaw comprises drive means for displacing the second clamping jaw out of a rest position defining said starting position wherein said second clamping jaw, viewed in the direction of forward movement of the clamping device, is located behind the first clamping jaw and into a work position defining said end position and engaging over the first clamping jaw and pressing an engaged product against said first clamping jaw.

6. The apparatus as defined in claim 5, wherein:

said drive means comprises a four-bar link arrangement having a connecting rod at which there is secured the second clamping jaw.

7. An apparatus for stacking folded, continuously arriving printed products, especially products arriving in an imbricated product stream, comprising:

a single stacker device including a stacker chute;

an infeed device arranged ahead of the stacker device;

said infeed device comprising:

a first conveyor device for supplying the products, said first conveyor device having a predetermined conveying direction;

a second conveyor device arranged after the first conveyor device and leading to the stacker chute of the stacker device;

said second conveyor device and said first conveyor device coacting with one another so as to define a region of transfer for the products from the first conveyor device to the second conveyor device;

said second conveyor device at least at the transfer region, being arranged below said first conveyor device;

said second conveyor device at least at the transfer region, having a conveying direction opposite to the conveying direction of the first conveyor device;

a clamping device for selectively and temporarily fixedly holding at least one product;

means for moving the clamping device in the conveying direction of the second conveyor device between a starting position and an end position at a speed which is less than the conveying speed of the second conveyor device; and means for activating said clamping device for selectively and temporarily fixedly holding at least one product moving in the conveying direction of the second conveyor device during the movement of the clamping device thereby dividing the continuous stream into individual sections, and for subsequently deactivating said clamping device for allowing said at least one held product to be again conveyed by said second conveyor device.

8. The apparatus as defined in claim 7, wherein:

said clamping device has its starting region located at said region of transfer.

9. The apparatus as defined in claim 7, wherein:

said first conveyor device has a conveying path arranged above the second conveyor device;

stop means arranged at said conveying path of the first conveyor device;

said stop means serving as impact means for the products infed by the first conveyor device; and said clamping device in said starting position being located at the region of said stop means.

10. The apparatus as defined in claim 7, further including:

a carriage;

said means for moving the clamping device movably driving said carriage in the direction of the conveying of said second conveyor device;

said clamping device comprising two clamping jaws arranged at said carriage;

said two clamping jaws defining a first clamping jaw and a second clamping jaw;

the first clamping jaw being secured to said carriage; and said means for activating said clamping device moving the second clamping jaw towards the first clamping jaw for fixedly holding a product and away from said first clamping jaw for releasing the product.

11. The apparatus as defined in claim 10, wherein:

said activating means for moving said second clamping jaw comprises drive means for displacing the second clamping jaw out of a rest position, defining said starting position wherein said second clamping jaw, viewed in the direction of forward movement of the clamping device, is located behind the first clamping jaw, and into a work position defining said end position and engaging over the first clamping jaw and pressing an engaged product against said first clamping jaw.

12. The apparatus as defined in claim 11, wherein:

said drive means comprises a four-bar link arrangement having a connecting rod at which there is secured the second clamping jaw.

* * * * *